US008016444B2

(12) United States Patent
Cho et al.

(10) Patent No.: US 8,016,444 B2
(45) Date of Patent: Sep. 13, 2011

(54) WASHING MACHINE HAVING LAMP DEVICE AND CONTROL METHOD OF THE SAME

(75) Inventors: Han Ki Cho, Gimhae-si (KR); Deok Joon Jeong, Miryang-si (KR); Chang Woo Son, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 488 days.

(21) Appl. No.: 12/063,912

(22) PCT Filed: Jul. 28, 2006

(86) PCT No.: PCT/KR2006/002986

§ 371 (c)(1),
(2), (4) Date: Dec. 29, 2008

(87) PCT Pub. No.: WO2007/021082

PCT Pub. Date: Feb. 22, 2007

(65) Prior Publication Data

US 2009/0153057 A1 Jun. 18, 2009

(30) Foreign Application Priority Data

| | | |
|---|---|---|
| Aug. 18, 2005 | (KR) | 10-2005-0075872 |
| Sep. 30, 2005 | (KR) | 10-2005-0092249 |
| Sep. 30, 2005 | (KR) | 10-2005-0092253 |
| Sep. 30, 2005 | (KR) | 10-2005-0092365 |
| Sep. 30, 2005 | (KR) | 10-2005-0092386 |

(51) Int. Cl.
*H01K 7/00* (2006.01)
*A47L 9/30* (2006.01)

(52) U.S. Cl. ..... 362/91; 362/89; 68/3 R; 68/12.27

(58) Field of Classification Search ..... 362/91, 362/89, 800, 154, 249.02; 68/3 R, 12.19, 68/12.27

See application file for complete search history.

(56) References Cited

U.S. PATENT DOCUMENTS

| | | | | |
|---|---|---|---|---|
| 5,795,052 | A * | 8/1998 | Choi | 362/91 |
| 5,869,932 | A * | 2/1999 | Choi | 362/89 |

FOREIGN PATENT DOCUMENTS

| | | | |
|---|---|---|---|
| CN | 2271547 | | 12/1997 |
| DE | 4128904 | | 3/1993 |
| DE | 29717295 | | 3/1999 |
| DE | 199 06 964 | A1 * | 8/2000 |
| DE | 19906964 | | 8/2000 |
| EP | 0148775 | | 11/2000 |
| JP | 2000157781 | | 6/2000 |

* cited by examiner

*Primary Examiner* — Bao Q Truong
(74) *Attorney, Agent, or Firm* — KED & Associates LLP

(57) ABSTRACT

A washing machine and a method for controlling the same are provided. The washing machine includes a cabinet having a door on a front thereof, a tub in the cabinet that holds washing water, a drum rotatably mounted in the tub, a gasket mounted to connect openings of the door and the tub, and a lamp device having light emitting devices (LEDs) mounted on the gasket providing light an inside the washing machine. The method for controlling the washing machine includes turning on the LEDs providing light to the inside of the washing machine upon receiving an order of turning on a lighting through an LED input device, and turning off the LEDs upon receiving an order of turning off the lighting through the LED input device after the turning on the LEDs.

12 Claims, 11 Drawing Sheets

[Fig. 1]
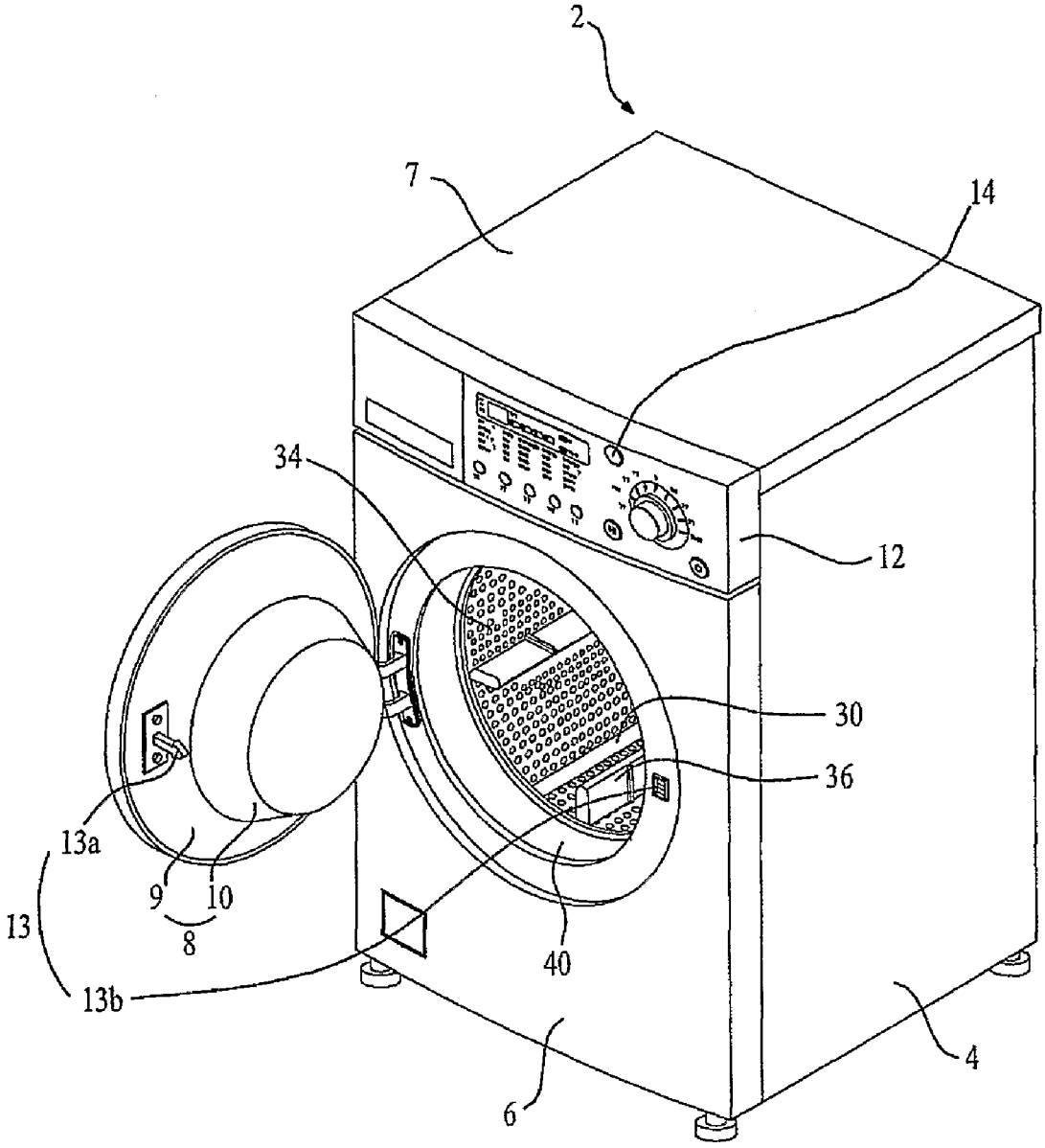

[Fig. 2]
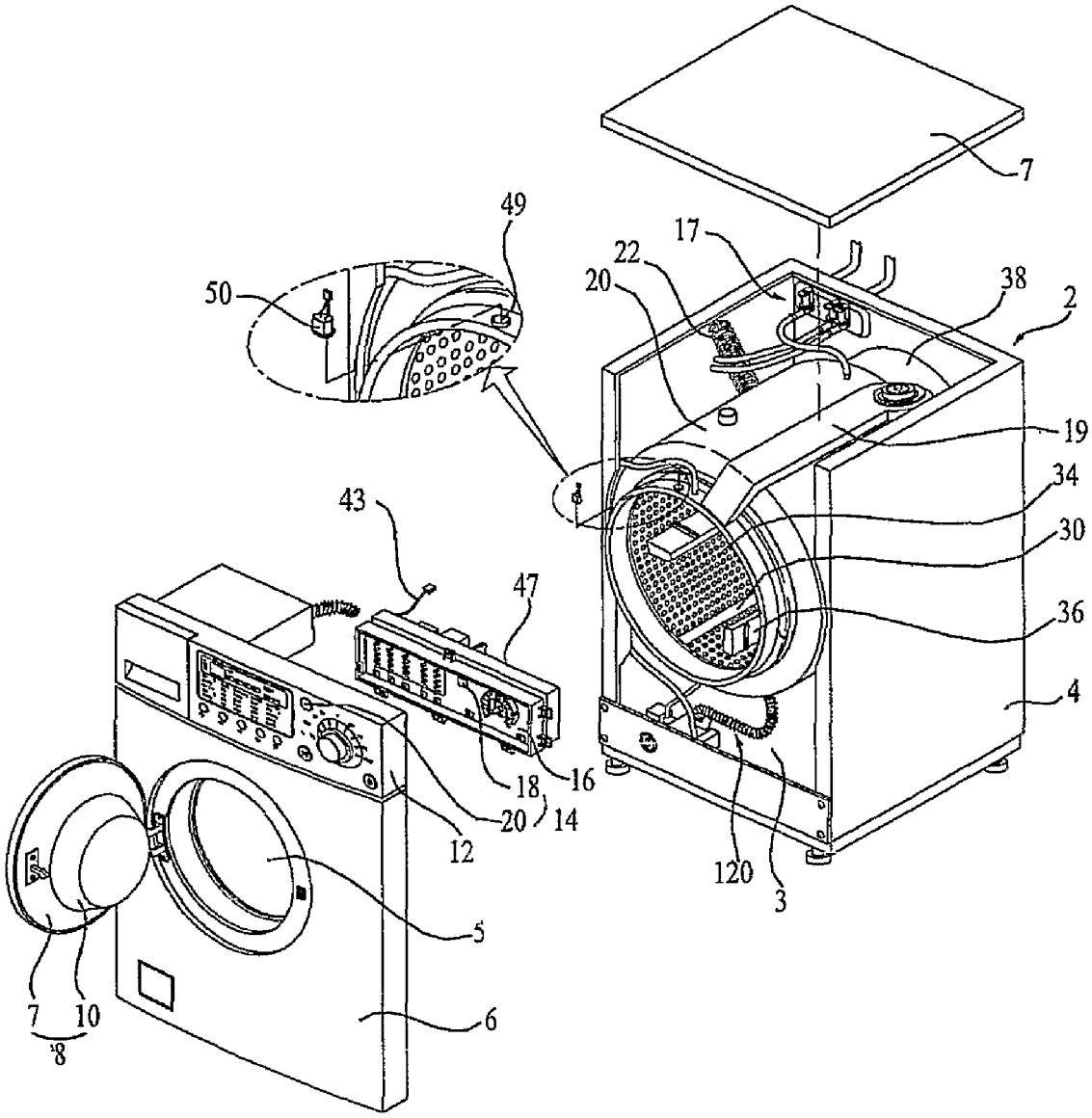

[Fig. 3]
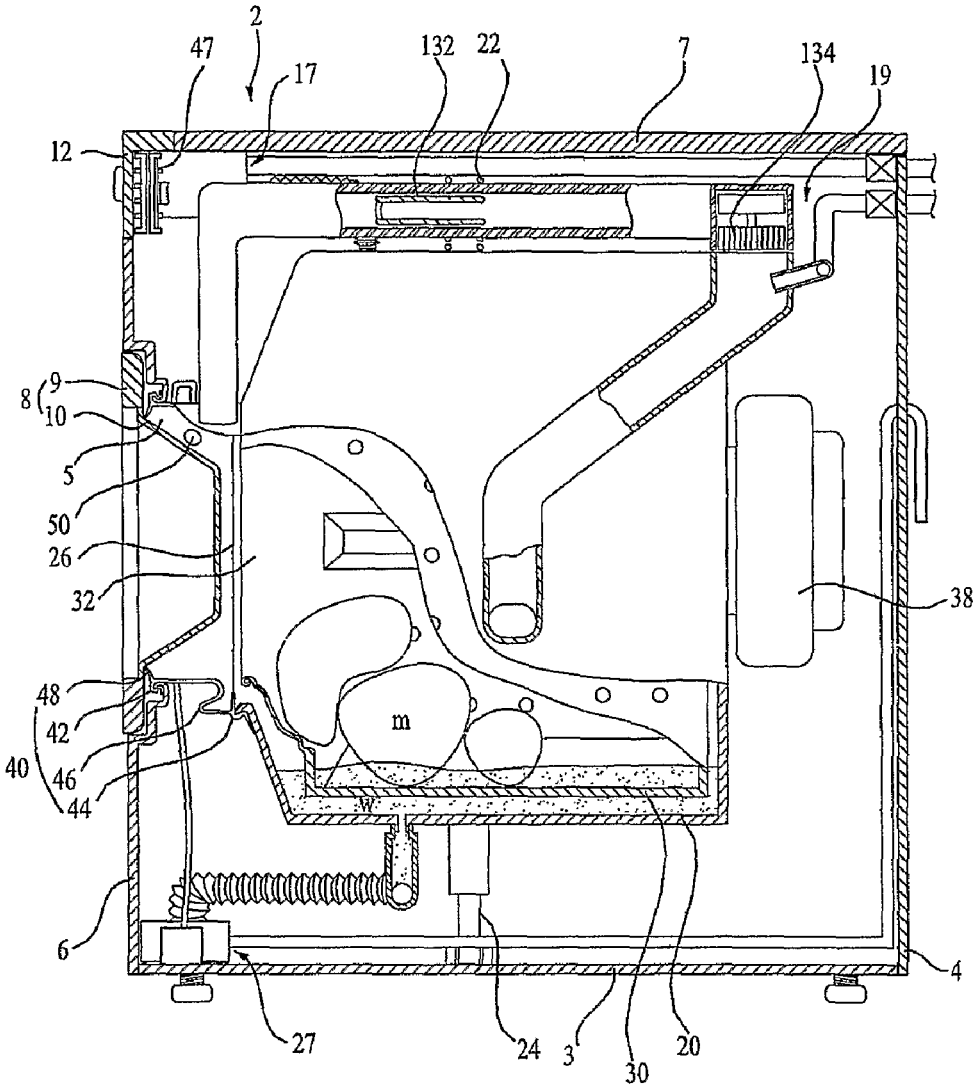
[Fig. 4]
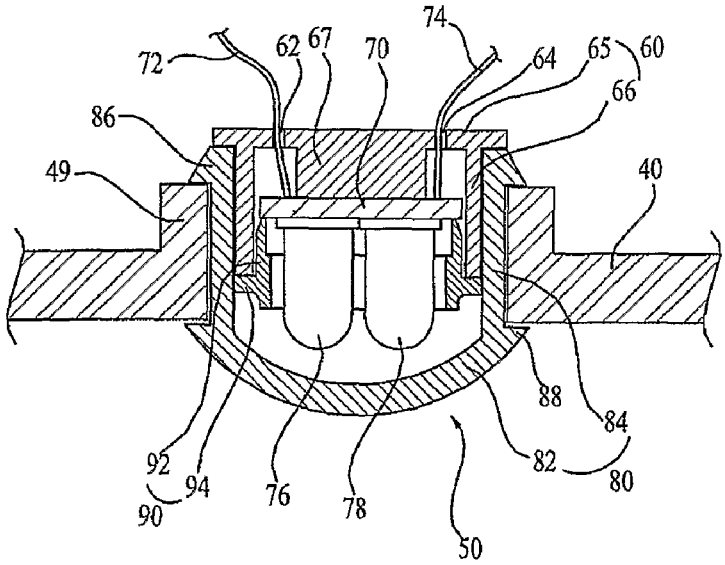

[Fig. 5]
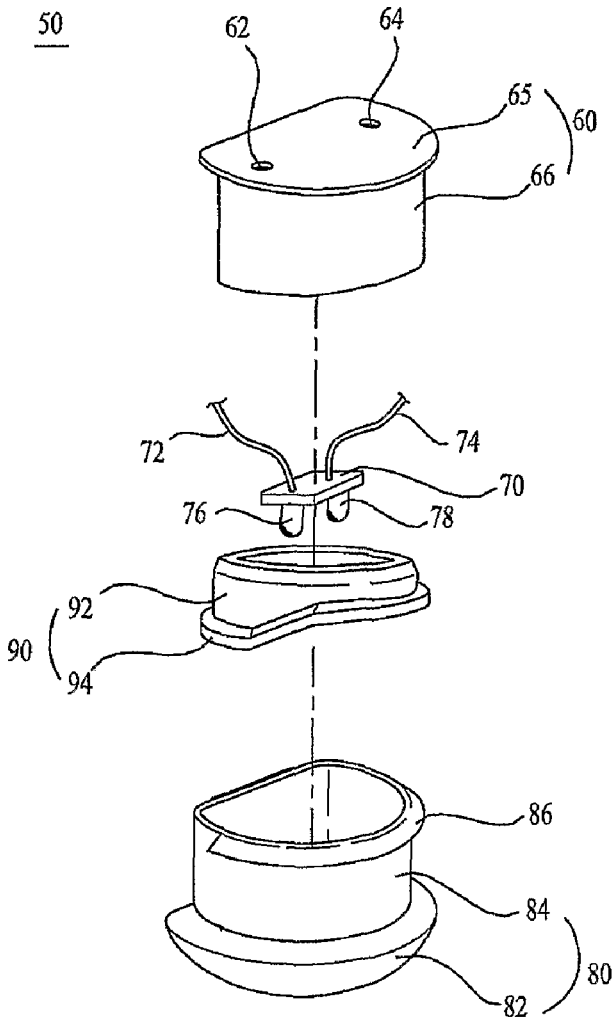
[Fig. 6]
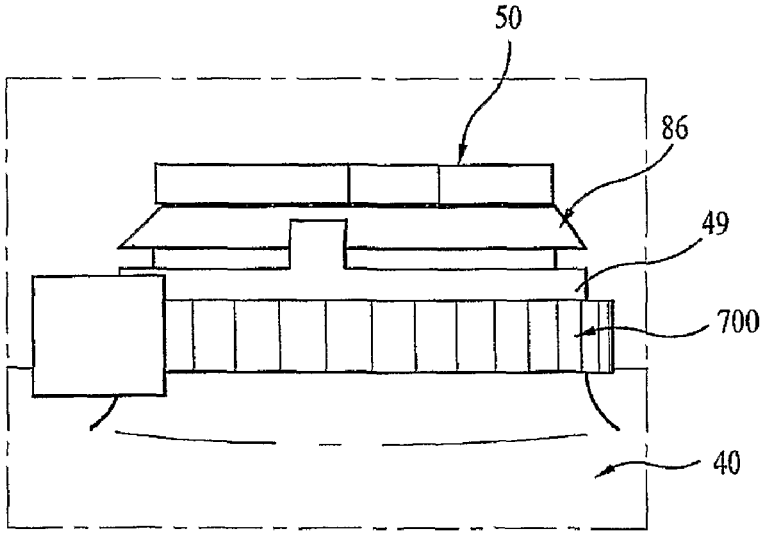

[Fig. 7]
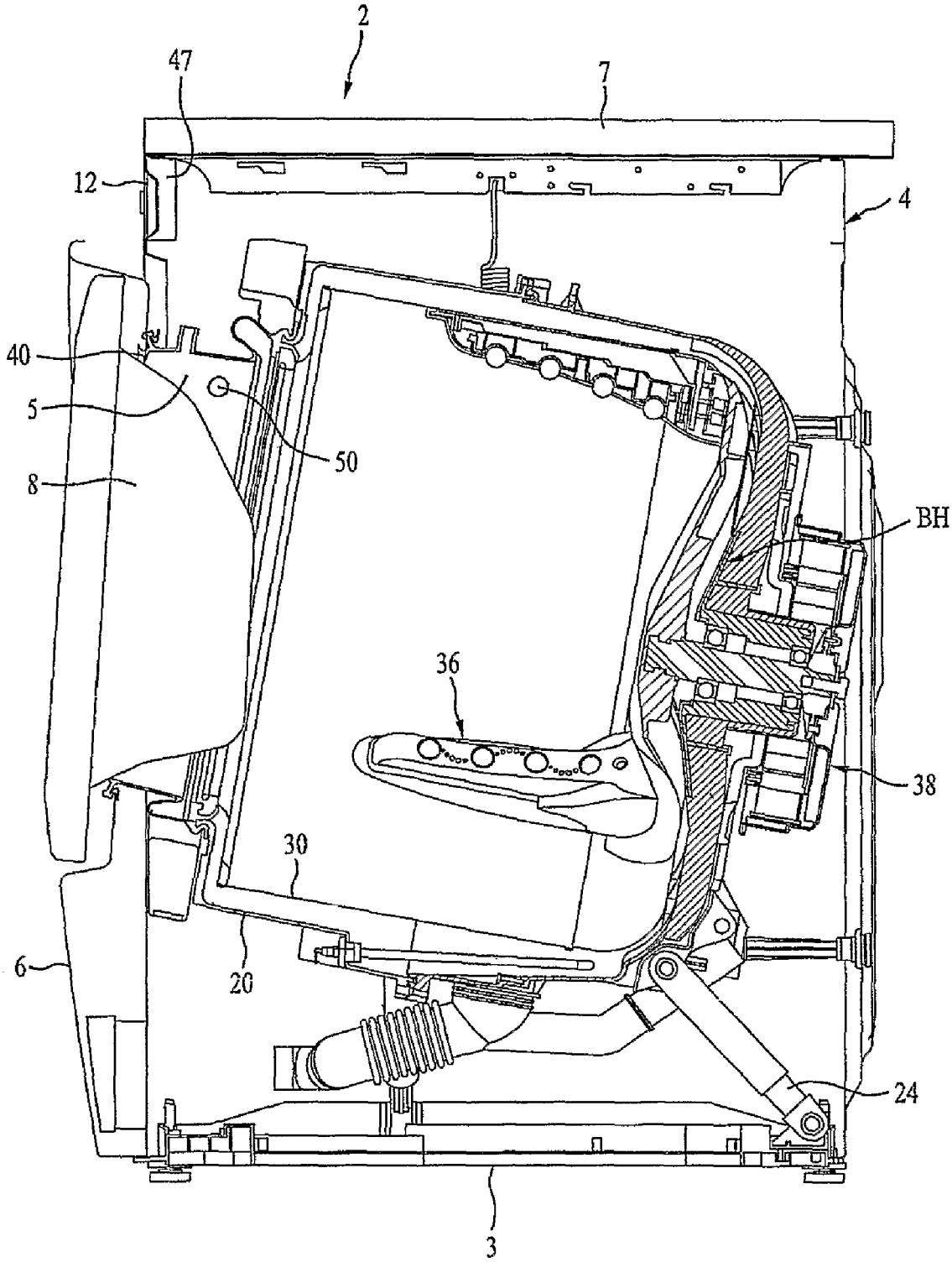

[Fig. 8]
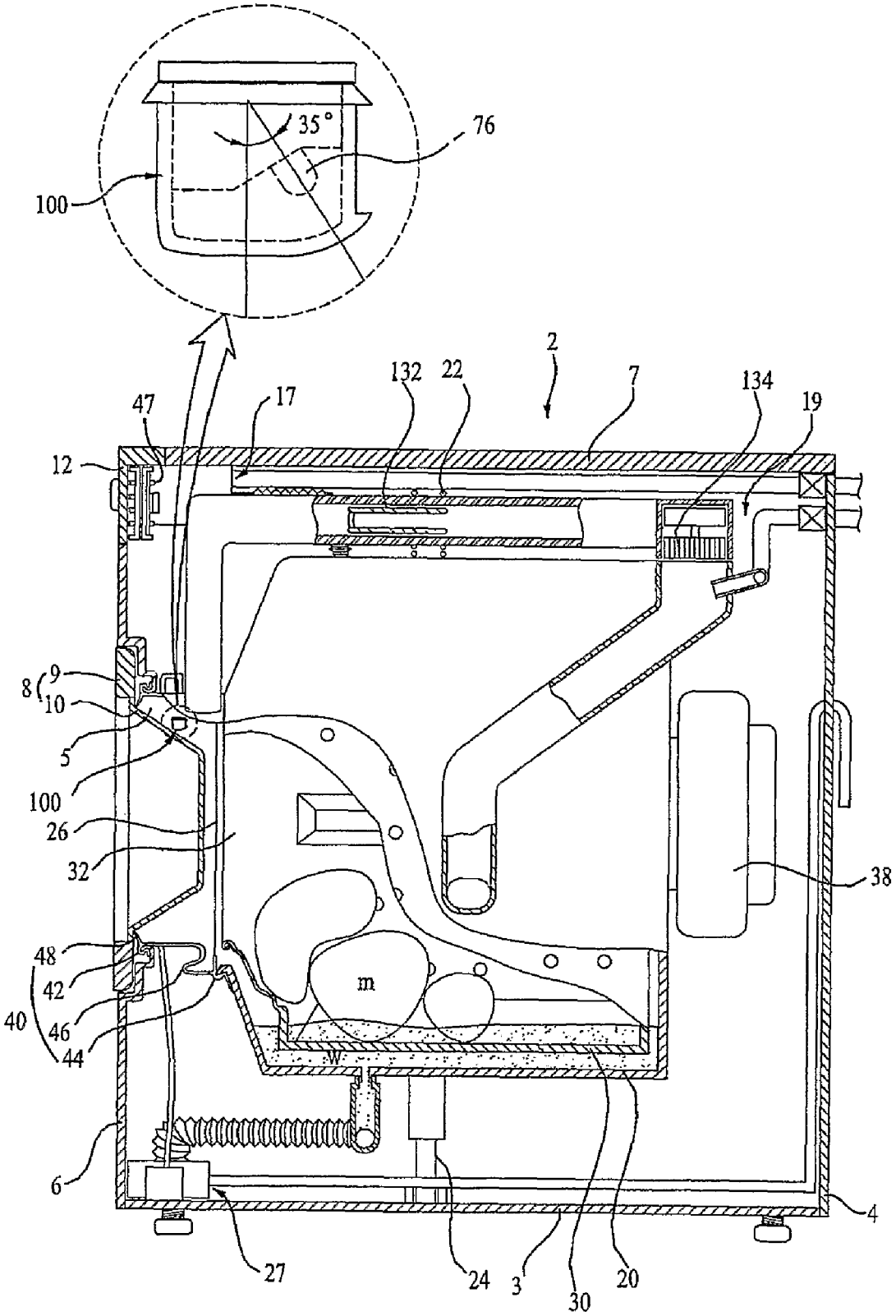

[Fig. 9]
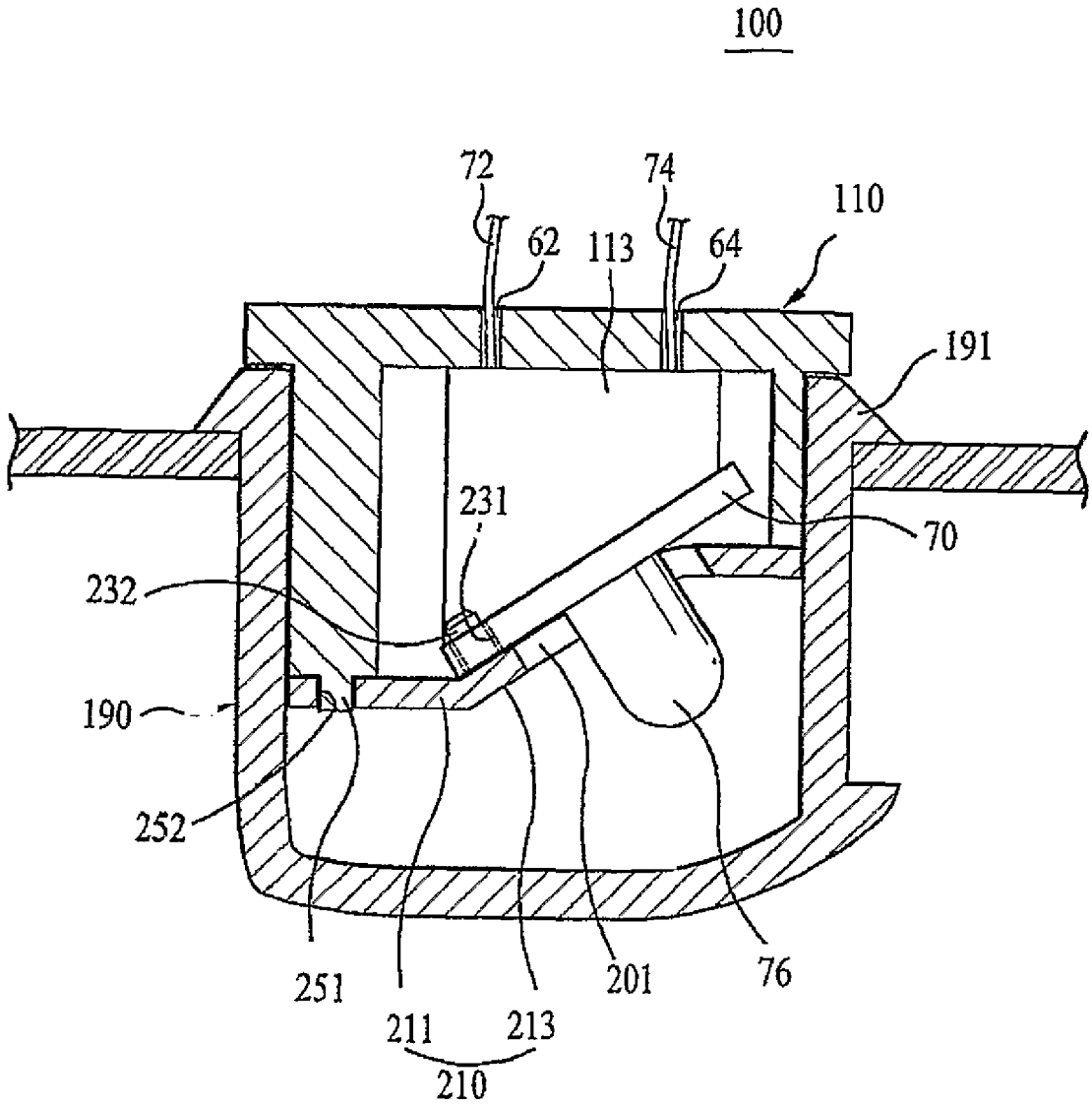

[Fig. 10]
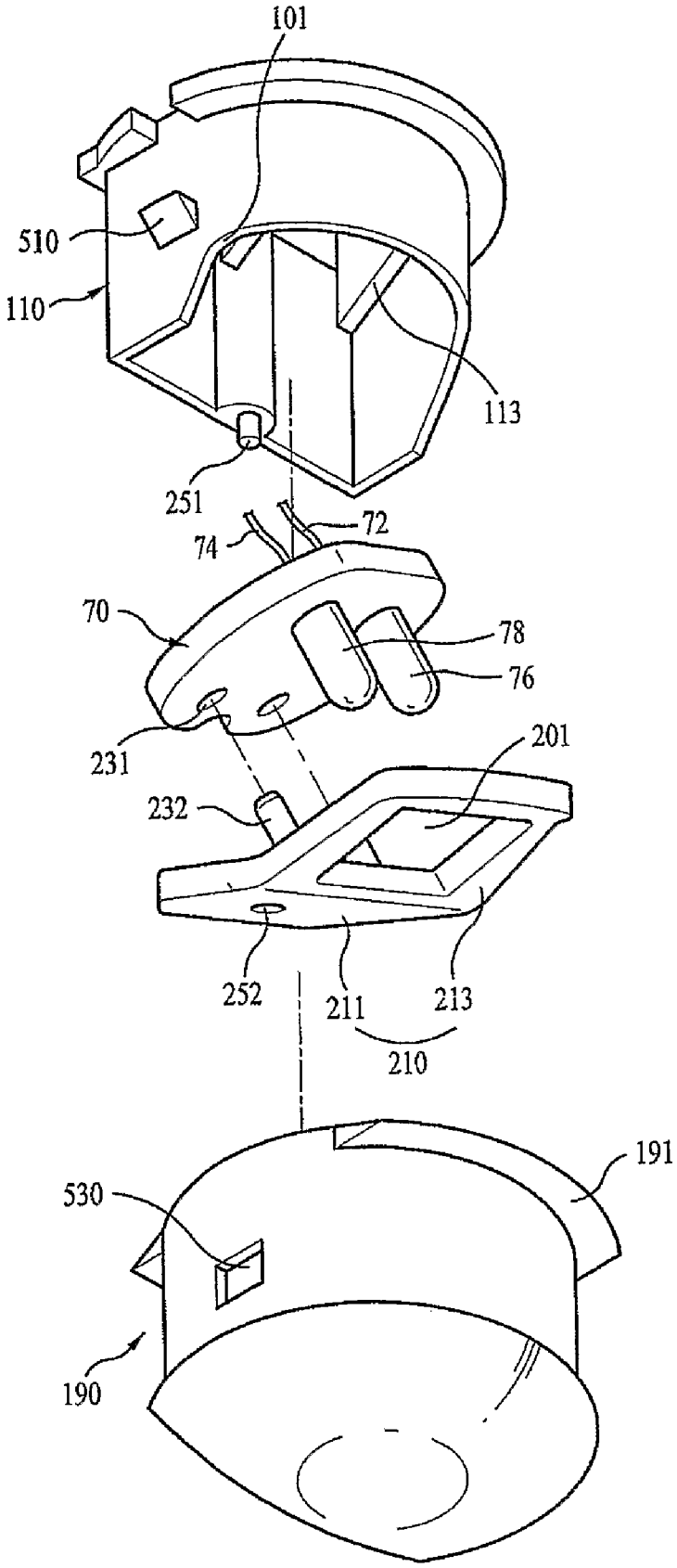

[Fig. 11]
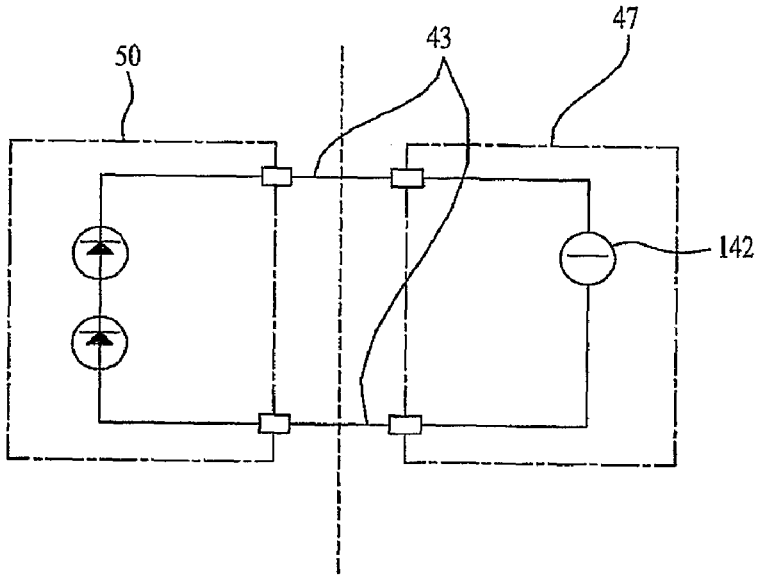
[Fig. 12]
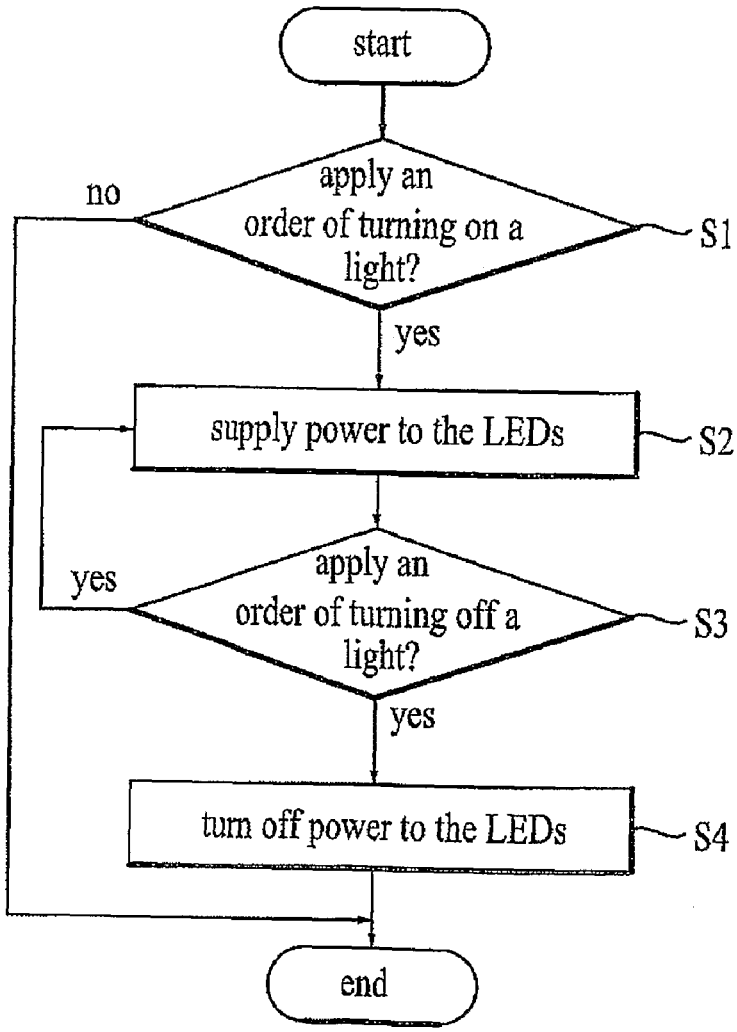

[Fig. 13]
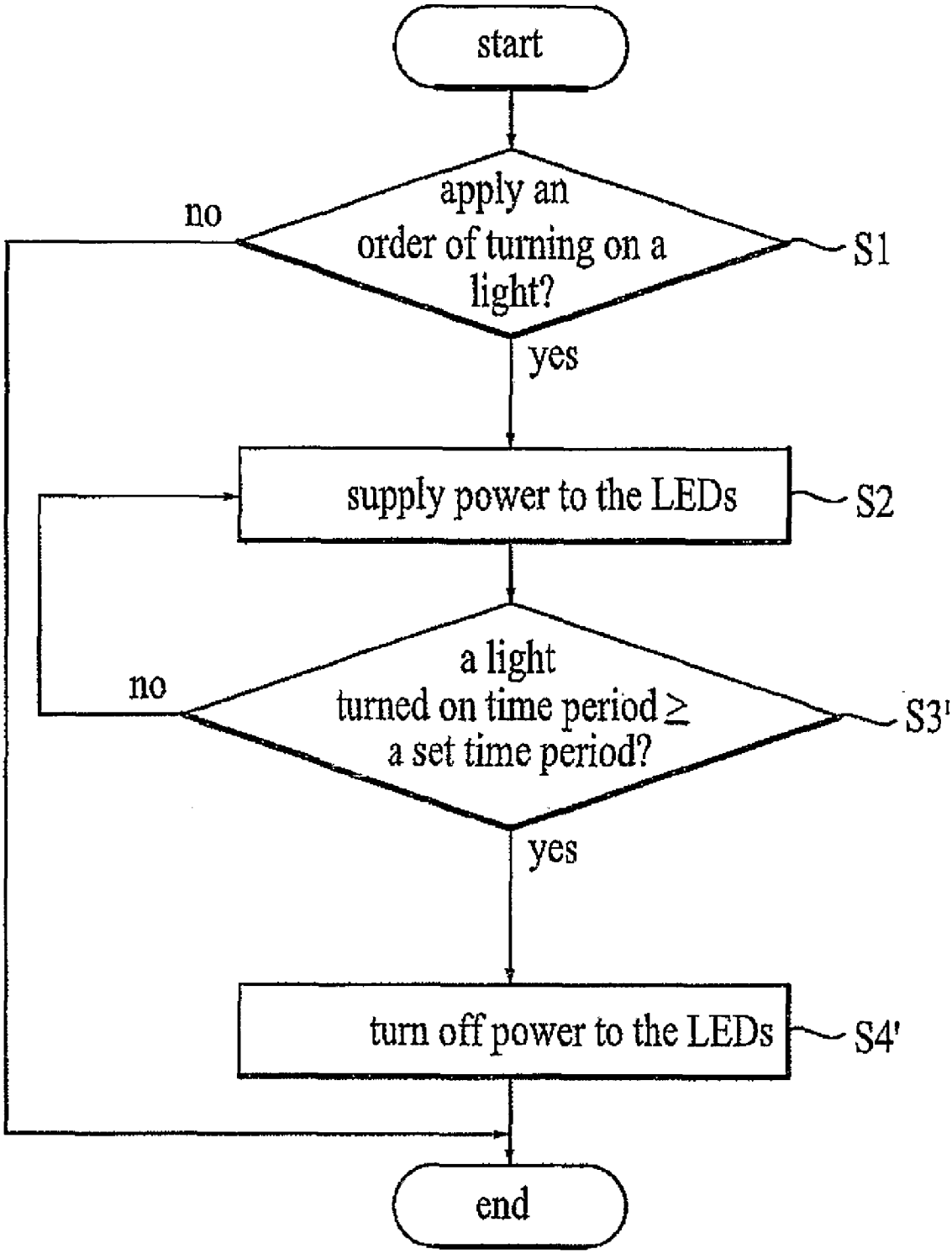

[Fig. 14]
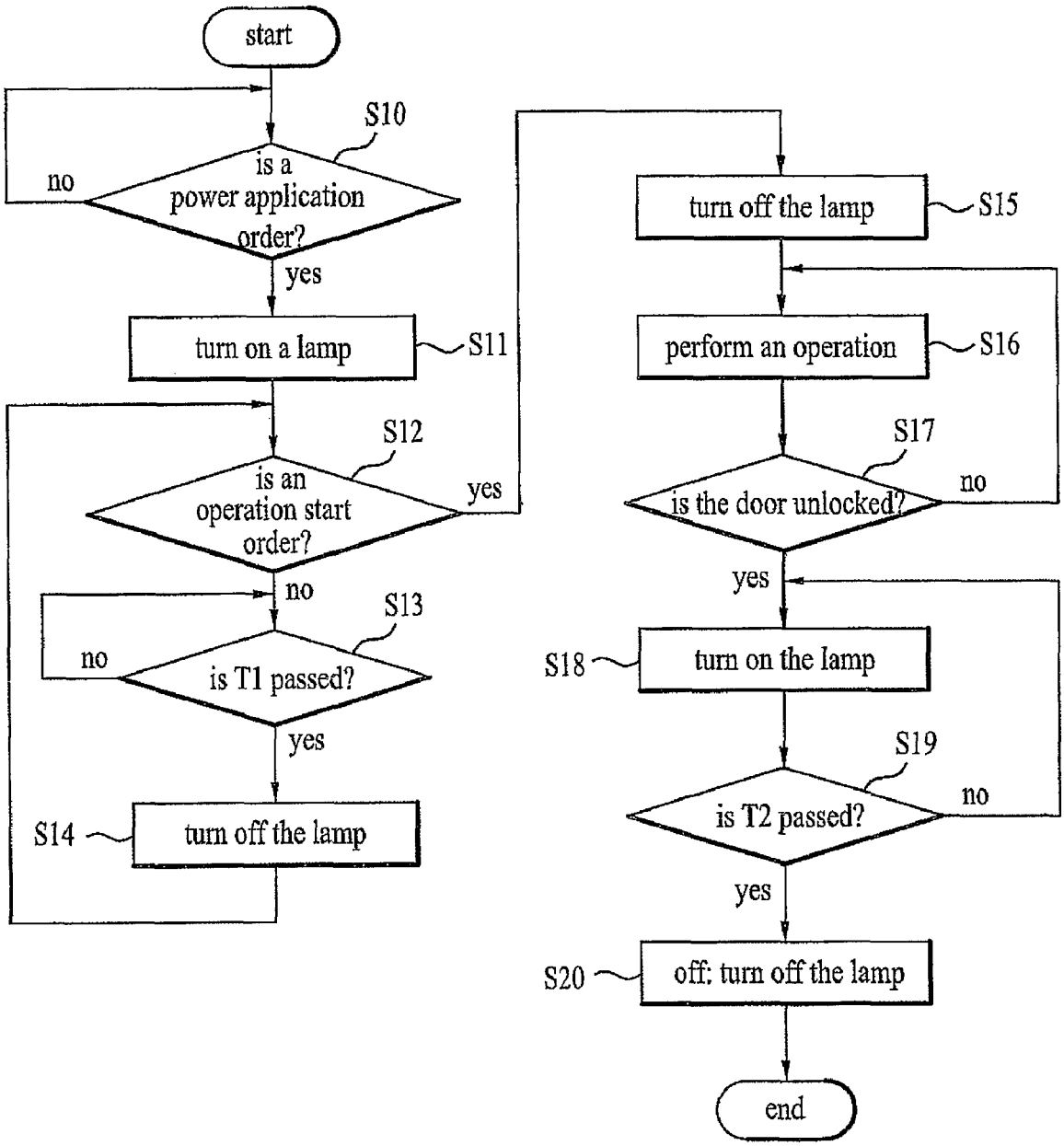

WASHING MACHINE HAVING LAMP DEVICE AND CONTROL METHOD OF THE SAME

TECHNICAL FIELD

The present invention relates to washing machines, and more particularly, to a washing machine having a lamp device with LED mounted to a gasket for lighting an inside of the washing machine, and a method for controlling the same.

BACKGROUND ART

In general, the washing machine has stationary parts, moving parts, and a door, and in view of function, a washing machine only having a washing function, a dryer only having a drying function, and a washing and drying machine having both the washing function and the drying function, all of which will be called as a washing machine, collectively.

A related art washing machine is provided with an AC lamp at a front portion of the stationary parts for lighting the inside of the washing machine, for turning on the AC lamp as the door is opened, and turning off the AC lamp as the door closed.

However, since the AC lamp is mounted to the stationary part, the related art washing machine has a problem in that the AC lamp is liable to suffer from breakage or damage due to vibration transmitted from the moving part to the stationary part, and security is poor because water can infiltrate into the AC lamp.

DISCLOSURE OF INVENTION

Technical Problem

An object of the present invention devised to solve the problem lies on providing a washing machine in which a lamp device having LED that is strong against vibration and has a long lifetime is mounted to a gasket for providing a washing machine fear of fault or becoming out of order of which is minimized.

Another object of the present invention lies on providing a washing machine having a lamp device having LED rigidly mounted so as not to shake for illumination of an inside of the washing machine.

A further object of the present invention lies on providing a method for controlling a washing machine having a lamp device provided thereto.

Technical Solution

To achieve these objects and other advantages and in accordance with the purpose of the invention, as embodied and broadly described herein, a washing machine includes a cabinet having a door on a front, a tub in the tub for holding washing water, a drum rotatably mounted in the tub, a gasket mounted to connect openings of the door and the tub, and a lamp device provided to the gasket.

Preferably, the gasket has a mounting hole for mounting the lamp device thereon with the lamp device passed therethrough, and preferably, the mounting hole is projected from an outside circumferential surface of the gasket.

Preferably, the washing machine further includes a cable tie provided to the mounting hole of the lamp device for preventing the lamp device from falling off the gasket.

Preferably, the lamp device is mounted on an upper portion of the gasket.

The lamp device may include a body, a PCB on the body, LEDs on the PCB, and a cap for protecting the LEDs and allowing transmission of a light from the LEDs.

Preferably, the body has an electric wire pass through hole for pass through of the wire connected to the PCB.

The body may include a rib projected therefrom for close contact of the PCB.

The lamp device may further include a PCB supporter for pressing the PCB toward the rib.

There may be a plurality of the LEDs.

The cap may include a first stopper to be held in an outer direction of the gasket, and a second stopper to be held in an inner direction of the gasket so that the cap is held at the gasket in mounting the cap.

The cap may have a curved portion.

The washing machine may further includes an LED input unit for operation of the LEDs.

In the meantime, the tub may be mounted tilted in the cabinet.

In another object of the present invention, a washing machine includes a cabinet having a door on a front, a tub in the tub for holding mashing mater, a drum rotatably mounted in the tub, a gasket mounted to connect openings of the door and the tub, and a lamp device mounted on the gasket, the lamp device having LEDs mounted therein with a tilting angle such that the LEDs are directed toward a center of the drum.

Preferably, the lamp device has a mounting hole for passing and mounting of the lamp device, and preferably, the mounting hole is projected from an outside circumference of the gasket.

The washing machine may further include a cable tie provided to the mounting hole of the lamp device for preventing the lamp device from falling off the gasket.

The lamp device may be mounted at a center of an upper portion of the gasket.

The lamp device may include a body, a PCB mounted in the body with a tilting angle, at least one LED mounted with a tilting angle the same with the PCB, and a cap for protection of the LED and transmission of a light of the LED.

The tilting angle of the PCB or the LED is in a range of 30° to 40° from a center of the body toward the drum.

Preferably, the body has a wire pass through hole for pass through of electric wires connected to the PCB.

The lamp device may further include a coupling unit for coupling the body to the cap.

The coupling unit may include a plurality of hooks on an outside circumference of the body, and hook holes in an outside circumferential surface of the cap for engagement with the hooks.

The lamp device may further include a PCB supporter for fixedly securing the PCB to the body.

The PCB supporter may include a plate having an opening for exposing the LEDs therethrough, at least one first holding hole in the PCB, and a first holding projection projected from an underside of the plate with a tilting angle, for engagement with the first holding hole in the PCB.

The PCB supporter may further include a second holding projection projected from a top of the body, and a second holding hole in the plate at a position opposite to the second holding projection for engagement with the second holding projection.

In another aspect of the present invention, a method for controlling a washing machine includes a first step for turning on LEDs in a lamp device for lighting an inside of the washing machine upon reception of an order of turning on a lighting through an LED input unit, and a second step for turning off the LEDs upon reception of an order of turning off the lighting through the LED input unit after the first step.

In further aspect of the present invention, a method for controlling a washing machine having LEDs for lighting an inside space, and a door locking unit for preventing the door from opening in the middle of operation, the method comprising the steps of turning on the LEDs for a first set time period T1 upon reception of an order of application of power, and turning on the LEDs for a second set time period T2 when the door locking unit is unlocked after starting of washing operation.

In this instance, the method may further include the step of turning off the LEDs when the first set time period and the second set time period are passed.

The method may further include the step of turning off the LEDs forcibly if a washing operation starting order is received within the first set time period after turning on the LEDs according to the power application order even if the first set time period T1 is not passed.

The first set time period T1 is shorter than the second set time period T2.

The unlocking of the door locking device is release of a door lock state for enabling opening of the door upon reception of a temporary stop order upon finishing, or in the middle of washing operation.

The unlocking of the door locking device according to the temporary stop order is unlocking of the door locking device only when a washing water level is below a preset water level or a washing water temperature is below a preset temperature at the time point the temporary stop order is received.

ADVANTAGEOUS EFFECTS

Since the washing machine of the present invention is provided with a lamp device having LEDs that have a long lifetime and strong against vibration more than a lamp for an inside lighting, the washing machine of the present invention has a significantly high industrial applicability owing to advantages of prevention of damage caused by vibration, to minimize defects.

Moreover, the mounting of the lamp device on the elastic gasket that seals between at least one opening of the tub among the laundry opening of the cabinet and the door minimizes impact transmitted to the LEDs, to prevent the LEDs suffering from damage caused by vibration or the like.

Moreover, the mounting hole in the gasket for mounting the lamp device with the lamp device passed therethrough enables to dispense with a separate injection molding piece for protection of the lamp device, and easy and quick mounting of the lamp device as the lamp device can be mounted by placing the lamp device into the mounting hole, simply.

Moreover, the firm holding of the lamp device with the mounting hole projected from an outside circumferential surface of the gasket can minimize the lamp device accentual falling off the gasket.

Moreover, the mounting of the lamp device at an upper portion of the gasket permits to prevent the lamp device suffering from damage, waste threads from entering into the lamp device, or infiltration of washing water into the lamp device, which can take place when the lamp device is mounted at a lower portion of the gasket.

Moreover, the lamp device including a body, a PCB on the body, LEDs on the PCB, and a cap for protection of the LEDs and transmission of a light can prevent washing water from infiltrating into the lamp device.

Moreover, the plurality of LEDs enables to secure an adequate luminance, and adjustment of the luminance according to a number of turned on LEDs.

Moreover, the curved portion of the cap enables to prevent the laundry suffering from damage that can take place at the time of putting in/taking out the laundry, and the light from the LEDs to reach deep into the drum because a position of the LEDs can be lowered to the maximum.

Moreover, the LED input unit further included to the washing machine for operation of the lamp device enables the user to select operation of the lamp device.

Moreover, since the LEDs are mounted on the PCB, and in turn, the PCB is fixedly secured to the body by the PCB supporter, there will be no variation of a position or angle of the PCB caused by vibration or the like, not to vary an angle of illumination.

Moreover, the tilted mounting of the lamp device in the body of the washing machine enabling a light from the LED emitted toward a center of the drum to light an inside of the drum, entirely.

Moreover, the formation of the mounting hole in the gasket and application of a cable tie for fixedly securing the lamp device to the gasket permits reduction of a unit cost and an assembly time period.

Moreover, the turning on of the LEDs in the lamp device upon reception of a lighting order for lighting an inside of the washing machine enables to determine a state of the laundry or an extent of washing without opening the door even in the middle of washing operation.

Moreover, the turning off of the LEDs at a preset time after turning on the LEDs permits turning off of the LEDs without any additional operation, and saves power.

Moreover, the control of the lamp device with software for lighting the inside space enables to dispense with unnecessary structure and wiring, to provide a product of simpler structure.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 illustrates a perspective view of a washing machine in accordance with a preferred embodiment of the present invention;

FIG. 2 illustrates an exploded perspective view of a washing machine in accordance with a preferred embodiment of the present invention;

FIG. 3 illustrates a sectional view of a washing machine in accordance with a preferred embodiment of the present invention;

FIG. 4 illustrates an enlarged sectional view of a lamp device in accordance with a preferred embodiment of the present invention;

FIG. 5 illustrates an exploded perspective view of a lamp device in accordance with a preferred embodiment of the present invention;

FIG. 6 illustrates a section of a tilted type washing machine of the present invention;

FIG. 7 illustrates a diagram showing a lamp device fastened with a cable tie in accordance with a preferred embodiment of the present invention, schematically;

FIG. 8 illustrates a section of a washing machine having a lamp device in accordance with another preferred embodiment of the present invention mounted thereon;

FIG. 9 illustrates an enlarged sectional view of a lamp device in accordance with another preferred embodiment of the present invention;

FIG. 10 illustrates an exploded perspective view of a lamp device in accordance with another preferred embodiment of the present invention;

FIG. 11 illustrates a circuit diagram of an LED circuit in accordance with the present invention, schematically;

FIG. 12 illustrates a flow chart showing the steps of a method for controlling a washing machine in accordance with a preferred embodiment of the present invention;

FIG. 13 illustrates a flow chart showing the steps of a method for controlling a washing machine in accordance with another preferred embodiment of the present invention; and FIG. 14 illustrates a flow chart showing the steps of a method for controlling a washing machine in accordance with another preferred embodiment of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts, and repetitive description of which will be omitted.

FIG. 1 illustrates a perspective view of a washing machine in accordance with a preferred embodiment of the present invention, FIG. 2 illustrates an exploded perspective view of a washing machine in accordance with a preferred embodiment of the present invention, and FIG. 3 illustrates a sectional view of a washing machine in accordance with a preferred embodiment of the present invention.

Referring to FIGS. 1 to 3, the washing machine includes a cabinet 2 which forms an exterior thereof having a base pan 3 with a plurality of legs, a cabinet body 4 on the base pan 3 having opened front, and top, a cabinet cover 6 on the front of the cabinet body 4 having a laundry opening 5 for introduction of laundry m, and a top plate 7 on the top of the cabinet body 4.

There is a door 8 mounted on the cabinet cover 6 for opening/closing the laundry opening 5.

The door 8 includes a door frame 9 joined to the cabinet cover 6 with a hinge, and a door glass 10 mounted on a center of the door frame 9.

In the meantime, there is a door locking unit 13 for preventing the door 8 from opening during operation.

The door locking unit 13 includes a latch 13*a* on the door 8, and a door lock assembly 13*b* on the body 4, for preventing the door 8 from opening during operation by holding the door lock switching assembly 13*b* with the latch 13*a* under the control of the microcomputer.

The door locking device 13 is provided for preventing the door 8 from opening during operation in response to an electric signal from the microcomputer. There may be a variety of systems and structures of door locking means.

The door glass 10 is protruded inwardly toward an inside of the drum 30 to be described later.

On one side of the cabinet 6, specifically, on an upper side of the front of the cabinet 6, there is a control panel 12 mounted thereon for controlling the washing machine.

On the control panel 12, there is an LED input unit 14 for lighting the inside of the washing machine for user's input.

Referring to FIG. 2, the LED input unit 14 may include a ted switch 18 on a display substrate 16 on an inside of the control panel 12, and a button 20 on the control panel 16 arranged to press the ted switch 18, or alternatively, a rotary switch on the display substrate 16, and a rotary knob rotatably mounted on the control panel 12. The description hereafter will be based on the LED input unit 14 including the ted switch 18 and the button 20.

In the meantime, referring to FIGS. 2 and 3, on an inside of the cabinet 2, there is a tub 20 for holding water (hereafter will be called as washing water) having detergent mixed therewith during washing, holding clean water without the detergent mixed therewith during rinsing, and collecting water extracted from the laundry m during spinning.

Referring to FIG. 3, the tub 20 is suspended from the cabinet body 4 with springs 22 and supported with dampers 24 on the base pan 3.

The tub 20 is positioned horizontally, or tilted at a predetermined angle (See FIG. 6), and has an opening 26 in rear of the laundry opening 5 in the cabinet 2.

There is a drum 30 rotatably mounted in the tub 20 for holding laundry m.

The drum 30 has a hollow cylindrical laundry opening 32 in a front for introduction/taking out the laundry m, a plurality of pass through holes 34 in a circumference or rear for free flow of washing water or air, and a lifter 36 on an inside circumference for lifting and dropping the laundry m or the washing water w.

The drum 30 is arranged such that a lower portion is submerged in the washing water w in the tub 20.

There is a motor 38 mounted on the tub 20 for rotating the drum 30.

Mounted on the tub 20, there is a gasket 40 for preventing the laundry m, the washing water w, and the air from coming out between one of the laundry opening 5 and the door 8 and the opening 26.

The gasket 40 is formed of an elastic material, such as rubber, and moves in front/rear directions, or up/down directions at the time the tub vibrates, to damp and absorb the vibration of the tub 20.

That is, the gasket 40 is mounted between the stationary parts of the cabinet 2, the door 8, and the like and the moving parts of the motor 38 and the like, for sealing a gap between the stationary parts and the moving parts, and minimizing transmission of the vibration from the moving parts to the stationary parts.

Referring to FIG. 3, the gasket 40 includes a front end insert 42 for inserting in the laundry opening 5 of the cabinet cover 6, a rear end insert 44 for inserting in the opening 26 of the tub 20, and a folding portion 46 between the front end insert and the rear end insert 44.

The gasket 40 also includes a door sealing portion 48 for being brought into close contact to the door glass 10 when the door 8 is closed.

In the meantime, the washing machine includes a lamp device 50 for lighting an inside of the washing machine, specifically, the drum 30 for easy determination of a state of the laundry m or an extent of washing from an outside of the washing machine.

Though the lamp device 50 can be mounted on the stationary parts, such as the cabinet 2 or the door 8, or the like as far as the position enables to direct a light to the inside of the drum 30, it is preferable that the lamp device 50 is mounted on, not the stationary parts, but the tub 20, the gasket 40, or the like, because, if the lamp device 50 is mounted on the stationary parts, it is liable that the LED is suffer from damage by the vibration or the like transmitted from the moving parts, such as the tub 20 to the stationary part.

Moreover, though the lamp device 50 can be mounted on the tub 20, because it is liable that the lamp device 50 is suffer from damage by the vibration from the tub 20, it is preferable that the lamp device 50 is mounted on the gasket 40 that dampens and absorbs the vibration of the tub 20, and more preferably, of portions of the gasket 40, on a front portion far from the tub 20, rather than a rear portion near to the tub 20.

Referring to FIGS. 2 and 3, the lamp device 50 will be described on an assumption that the lamp device 50 is mounted on the gasket 40.

The gasket 40 has a mounting hole 49 where the lamp device 50 passes through.

Of the portion of the gasket 40, though the lamp device 50 may mounted on a lower portion or an upper portion so as to pass therethrough, if the lamp device 50 is mounted on the lower portion, because it is liable that the washing water w infiltrates into the lamp device 50, the lamp device 50 is suffer from damage, or fall off by the laundry m when the laundry m is put in/taken out, and waste thread or the like is inserted between the lamp device 50 and the mounting hole 49, it is the most preferable that the lamp device 50 is mounted on the upper portion.

That is, it is preferable that the mounting hole 49 is positioned at a center of an upper portion or slightly spaced from the center of the upper portion of the gasket 40.

The mounting hole 49 is projected from the gasket 40 to a predetermined height for firm holding of the lamp device 50 and forming a maximum contact area with the lamp device 50.

The mounting hole 49 is projected from an outside circumference of the gasket 40 taking damage to the laundry that can take place when the mounting hole 49 is projected from an inside circumference of the gasket 40 into account.

Both the mounting hole 49 and the lamp device 50 have flat portions respectively for preventing the lamp device 50 from rotating on the mounting hole 49.

A reference symbol 17 in FIGS. 2 and 3 denotes a water supply unit for supplying water mixed with or without detergent to the tub 20, a reference symbol 27 denotes a pumping unit for pumping the washing water w from/to the tub 20 to/from an outside of the tub, and a reference symbol 19 denotes a drying unit having a heater 132, a fan 134, and so on for drying the laundry m in the drum 30.

A reference symbol 47 denotes a controller for controlling various moving components of the washing machine, and particularly, supplying or cutting off DC power to the lamp device 50 according to input to the LED input unit 14, and a reference symbol 43 denotes a connector which connects the LED assembly 50 to the controller 47.

FIG. 4 illustrates an enlarged sectional view of a lamp device in accordance with a preferred embodiment of the present invention, and FIG. 5 illustrates an exploded perspective view of a lamp device in accordance with a preferred embodiment of the present invention.

Referring to FIGS. 4 and 5, the lamp device 50 includes a PCB (Printed Circuit Board) 70 on the body 60, LEDs (Light Emitting Diodes) 76 and 78 on the PCB 70, and a cap 80 through which lights from the LEDs 76 and 78 transmit, for protection of the LEDs 76 and 78.

The body 60 has wide pass through holes 62 and 64 for passing through of the wires connected to the PCB 70.

The body 60 includes a plate portion 65 having the wire pass through holes 62 and 64 formed therein, and a cylindrical portion 66 projected from the plate portion 65 having a space formed therein for receiving the PCB 70.

The body 60 has a rib 67 projected to a predetermined height from the plate portion 65 for being brought into close contact with the PCB 70.

The rib 67 is projected lower than the cylindrical portion 66 so that the PCB 70 can be positioned in the cylindrical portion 66 of the body 60.

There are a plurality of LEDs 76 and 78 provided to the lamp device 50.

It is apparent that the plurality of LEDs 76 and 78 are connected to the PCB 70 circuit in parallel or series.

If the plurality of LEDs 76 and 78 are connected to the PCB 70 circuit in parallel, a brightness of the lamp device 50 can be controlled by turning on only a few, or all of the LEDs 76 and 78.

It is assumed that the PCB 70 circuit is connected in series in the following description.

It is preferable that the PCB 70 is tilted in a direction of the drum 30 so that lights from the LEDs 76 and 78 are directed toward the inside of the drum 30.

The cap 80 includes a dome portion 82 to form a bottom of the lamp device 50 exposed to an outside circumference of the gasket 49, not only for preventing the laundry suffering from damage which is liable to be taken place at the time the laundry is put in/taken out of the drum 30, but also reducing positions of the LEDs 76 and 78 to the maximum, and a cylindrical portion 84 projected from the dome portion 82 for placing in the cylindrical portion 65.

The cap 80 is held at the gasket 40 without any other separate fastening member.

That is, the cap 80 includes a first stopper 86 to be held in an outer direction of the gasket 40, and a second stopper 88 to be held in an inner direction of the gasket 40.

The first stopper 86 is projected from a top portion of the cylindrical portion 84.

The second stopper 88 is projected from a bottom portion of the cylindrical portion 84 except a portion of a bottom circumference of the cylindrical portion 84 for easy insertion of the lamp device 50 into the mounting hole 49 in the gasket 40.

The lamp device 50 further includes a PCB supporter 90 for pressing the PCB 70 toward the rib 67.

The PCB supporter 90 includes a cylindrical portion 92 for placing in the cylindrical portion 66 of the body 60, pressing the PCB 70, and enabling the LEDs 76 and 78 passed therethrough and projected therefrom, and a stopper 94 projected from the cylindrical portion 92 so as to be held at the bottom of the cylindrical portion 66 of the body 60.

In the meantime, referring to FIG. 6, there is a cable tie 700 for firmer fastening of the lamp device 50 to the gasket 40.

In this instance, the cable tie 700 is mounted to surround an outside circumferential surface of the mounting hole 49 having the lamp device 50 passed through and held thereto, to squeeze the mounting hole 49, for firmer fastening of the lamp device 50 to prevent the lamp device 50 from falling off the gasket 40.

In the meantime, as a variation of the embodiment of the present invention, FIG. 7 illustrates a lamp device mounted on a tilted type washing machine having a tub mounted in a tilted position. Because the lamp device is identical to the foregoing embodiment, no more description of which will be given.

Next, a lamp device in accordance with another preferred embodiment of the present invention will be described with reference to FIGS. 8 and 9.

FIG. 8 illustrates a section of a washing machine having a lamp device in accordance with another preferred embodiment of the present invention mounted thereon, FIG. 9 illustrates an enlarged sectional view of a lamp device in accordance with another preferred embodiment of the present invention, FIG. 10 illustrates an exploded perspective view of a lamp device in accordance with another preferred embodiment of the present invention.

Referring to FIG. 8, the lamp device 100 is mounted on the gasket 40 with a tilting angle to face a center of the drum 30.

Referring to FIGS. 9 and 10, the lamp device 100 includes a cylindrical body 110, a PCB 70 mounted in the body with a tilting angle, at least one LED 76 and 78 mounted with a tilting angle the same with the PCB 70, and a cap 190 for protection of the LED 76 and 78 and transmission of a light from the LED 76 and 78.

The body 110 has wire pass through holes 62 and 64 for pass through of wires 72 and 74 connected to the PCB 70.

In the body 110, there is at least one seating projection 113 for seating the PCB 70, and the body 110 has a sloped portion 101 at one side of an upper side.

Another preferred embodiment of the present invention suggests two seating projections 113 each with a sloped top.

The top of the seating projection 113 is sloped for tilting both the PCB 70 and the LED 76 and 78 with a tilting angle that directs the LEDs 76 and 78 to the center of the drum 3.

The LEDs 76 and 78 are mounted with the tilting angle that directs the LEDs 76 and 78 to the center of the drum 3 so that the light from the LEDs 76 and 78 of the lamp device 100 is directed toward the center of an inside of the drum 3 to illuminate an entire inside of the drum even if the lamp device 100 is mounted on any portion of an inside circumferential surface of the gasket 40.

In the meantime, the lamp device 100 may further include a PCB supporter for pressing the PCB 70 toward the body 110. The PCB supporter may include a plate 210, a first holding hole 231 and a first holding projection 210.

The plate 210 has a horizontal portion 211 and a sloped portion 213 having a slope the same with the sloped portion 101 of the body 110, to cover an upper portion of the body 110.

In this instance, it is preferable that the sloped portion 213 has an opening 201 for exposing the LEDs 76 and 78 on the PCB 70.

The first holding hole 231 is in the PCB 70, for engagement with a first holding projection 232, to hold the PCB 70. In this instance, it is preferable that the first holding projection 232 is projected from the plate at the tilting angle, and the first holding hole 231 has a tilting angle the same with the first holding projection 232.

In the meantime, the PCB supporter may further include a second holding projection 251 projected from a top of the body 110 for firmer fastening of the PCB 70, and a second holding hole 252 in the plate 210 at a position opposite to the second holding projection 251 for engagement with the second holding projection 251.

The lamp device may further include a coupling unit for coupling the body. 10 to the cap 190. The coupling unit may include a plurality of hooks 510 on an outside circumferential surface of the body 110 and hook holes 530 in an outside circumferential surface of the cap 190 for engagement with the hooks 510 respectively.

In the meantime, it is preferable that the cap 190 of the lamp device 100 is formed of a transparent material for transmission of the light from the LEDs 76 and 78.

A process for assembling the lamp device in the drum type washing machine in accordance with another preferred embodiment of the present invention will be described.

Referring to FIG. 10, at first, the LEDs 76 and 78 are mounted on the PCB 70.

Then, the PCB 70 having the LEDs 76 and 78 mounted thereon is seated on the seating projections 113 in the body 110.

In this instance, since the seating projections 113 are sloped, the PCB 70 is also tilted.

Then, the plate 210 which is a supporter of the PCB is placed to cover an upper portion of the body 110, thereby preventing the PCB 70 from falling off the body 110.

Along with this, the first holding projection 232 on the plate 210 is placed in the first holding hole 231 in the PCB 70, and the second holding projection 251 on the body 110 is placed in the second holding hole 252 in the plate 210.

According to above steps, the LEDs 76 and 78 and the PCB 70 are fixedly secured in the body, with the LEDs 76 and 78 exposed through the opening 210 in the plate 210.

Next, the cap 190 is coupled to the body 110 with the coupling unit.

In this instance, the cap 190 is placed on the body 110 such that the cap 190 surrounds the body 110 until the hook 510 on the outside circumference of the body is engaged with the hook hole 530 in the outside circumferential surface of the cap 190.

According to these steps, the lamp housing 110 and the lamp cover 190 are coupled, to finish assembly of the lamp device 100.

Referring to FIG. 9, the lamp device 110 is fixedly secured to the gasket 40 thus, wherein the gasket 40 has a holding boss 41 for passing through a portion of the lamp device 100 to hold the lamp device 100, and the lamp cover 190 has a holding rib 191 at a lower end for preventing the lamp device 100 from falling off the holding boss 41.

In the meantime, as described before in one preferred embodiment of the present invention, a cable tie 700 is further provided for firmer fastening of the lamp device 100 to the gasket 40.

FIG. 11 illustrates a circuit diagram of an LED circuit in accordance with the present invention, schematically.

In an LED assembly, the LEDs 76 and 78 are connected to a DC power source 142 of the controller 47.

A method for controlling a washing machine having the lamp device in accordance with each of the preferred embodiment of the present invention will be described with reference to FIGS. 12 to 14.

FIG. 12 illustrates a flow chart showing the steps of a method for controlling a washing machine in accordance with a preferred embodiment of the present invention.

Referring to FIG. 12, in the method for controlling a washing machine, if the user inputs turn-on-light on the LED input unit 14 as shown in FIG. 7 in the middle of washing, ringing, spinning, or drying, the controller 47 supplies a DC power to the LEDs 76 and 78 of the lamp device 50 (S1 and S2).

The LEDs 76 and 78 emit lights by the DC power, which are passed through the cap 80 and 190 and directed toward the inside of the gasket 40 and the drum 30, such that the user can determine a state of laundry, or an extent of washing easily through the door glass 10 without opening the door 8 because the inside of the washing machine is light with the light directed thereto.

Thereafter, if the user inputs turn-off-light on the LED input unit 14, the controller 140 turn off the DC power to the LEDs 76 and 78 of the lamp device 50, to turn off the LEDs 76 and 78 (S3), and (S4).

In the meantime, even if vibration caused by the laundry placed out of a center is transmitted to the tub in the middle of the operation of the washing machine, a portion of the vibration is transmitted to and absorbed by the gasket 40, and since the lamp device 50 is mounted on the gasket 40, no, or least vibration is transmitted to the lamp device 50.

FIG. 13 illustrates a flow chart showing the steps of a method for controlling a washing machine in accordance with another preferred embodiment of the present invention.

Referring to FIG. 13, in the method for controlling a washing machine, if the user inputs turn-on-light on the LED input unit 14 as shown in FIG. 8 in the middle of washing, ringing, spinning, or drying, the controller 140 supplies a DC power to the LEDs 76 and 78 of the lamp device 50 or 100 regardless of closing/opening of the door 8 (S1 and S2).

Because the supply of the DC power to the LEDs 76 and 78, and consequential action thereof is identical to the method in accordance with one preferred embodiment of the present invention, detailed description of which will be omitted.

The controller 140 counts a time period after the LEDs 76 and 78 are turned on, and, if the time period after the LEDs 76 and 78 are turned on passes a preset time period (for an example, 3 minutes), the controller 140 turns off the DC power to the LEDs 76 and 78, to turn off the LEDs 76 and 78 (S3', and S4').

FIG. 14 illustrates a flow chart showing the steps of a method for controlling a washing machine in accordance with another preferred embodiment of the present invention.

The method for controlling lighting in accordance with each of preferred embodiments of the present invention includes the steps of turning on the LED for a first preset time period T1 if a power application order is received, and turning on the LEDs 76 and 78 for a second preset time period T2 if a door locking unit is unlocked after the washing is started.

The method may further include the step of turning off the LEDs 76 and 78 if the first preset time period T1 and the second preset time period T2 are passed.

The method may further include the step of turning off the LEDs 76 and 78 forcibly even if the first preset time period T1 is not passed if a washing start order is received within the first preset time period T1 after the LEDs 76 and 78 are turned on in response to the power application order.

The first preset time period T1 is shorter than the second preset time period T2.

The unlocking of the door locking unit is release of a door lock state if the washing is finished or a temporary stop order is received in the middle of washing such that the door can be opened/closed.

The release of a door lock state according to the temporary stop order is release of a door lock state limited only in cases when a washing water level is below a preset water level or a temperature of the washing water is below a preset temperature at the time the temporary stop order is received.

The method for controlling a washing machine will be described in more detail.

In general, the user inputs a power application order (power key) to a function operation unit (i.e., user input means) mounted on the body 10 of the drum type washing machine, selects a course proper to the laundry intended to wash from a plurality of washing course, and inputs a washing start order (a starting key).

Of the user's operations, it is determined whether there is an input of a power application order (S10) or not, if there is the input of the power application order, the LEDs 76 and 78 are turned on (S11), at once.

Once the LEDs 76 and 78 are turned on, the light from the lamp 61 is directed toward the inside of the tub 20 primarily, to illuminate the inside of the drum 30 through the holes in the inside wall of the drum 30 at the end.

Then, after the application of the power, it is determined whether the user selects a washing course, and inputs a starting order of the washing course or not (S12).

As a result of the determination (S12), if no starting order is inputted after application of the power, it is determined whether a first set time period T1 (for an example, approx. 3 minutes) is passed or not starting from the time the LEDs 76 and 78 are turned on (S13).

As a result of the determination (S13), if there is no input of the starting order until the first set time period T1 is passed after the LEDs 76 and 78 are turned on, i.e., after the application of the power, the LEDs 76 and 78 are turned off, forcibly (S14).

In the meantime, as the result of the determination, if the LEDs 76 and 78 are turned on, and there is an input of the starting order from the user within the first set time period T1, the LEDs 76 and 78 are turned off forcibly even if the first set time period is not passed (S15).

Along with this, the door lock switch assembly 13*b* is activated, to lock the latch 13*a* on the door 40 side for preventing the door 40 from opening during progress of the washing, and performs the washing course of the user's selection (S16).

Thereafter, unlocking of the door locking unit 13 is determined (S17).

In this instance, the door locking unit 13 can be unlocked in cases all operation is finished, or if a temporary stop order is received from the user in the middle of operation. With regard to the temporary stop order, in order to prevent overflow of the washing water, or accident caused by hot washing water, the door locking may be unlocked only when a washing water level or a washing water temperature at the time the order is received is below a reference level.

As the result of the determination (S17), if the operation is finished, or the temporary stop order is received to unlock the door locking unit 13, the LEDs 76 and 78 are turned on (S18) to light the inside of the drum 30 for easy determination of a state of the laundry or easy taking out of the laundry.

In this instance, the LEDs 76 and 78 are turned off automatically if a second set time period T2 (for an example, about 10 minutes) is passed (S19, and S20).

However, in a state the door locking unit 13 is unlocked by the temporary stop order, it is preferable that the LEDs 76 and 78 are turned off even if the second set time period is not passed if an operation start order is received from the user again.

Thus, the present invention turns on the LEDs 76 and 78 to illuminate the inside of the drum in cases the power is applied at an initial stage, or the door locking unit is unlocked regardless of opening/closing of the door.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

Since the washing machine of the present invention is provided with a lamp device having LEDs that have a long lifetime and strong against vibration more than a lamp for an inside lighting, the washing machine of the present invention has a significantly high industrial applicability using to advantages of prevention of damage caused by vibration, to minimize defects.

Moreover, the mounting of the lamp device on the elastic gasket that seals between at least one opening of the tub among the laundry opening of the cabinet and the door minimizes impact transmitted to the LEDs, to prevent the LEDs suffering from damage caused by vibration or the like. Accordingly, the washing machine of the present invention has significantly high industrial applicability.

Moreover, the tilted mounting of the lamp device in the body of the washing machine enabling a light from the LED emitted toward a center of the drum to light an inside of the drum, entirely. Accordingly, the washing machine of the present invention has significantly high industrial applicability.

Moreover, the formation of the mounting hole in the gasket and application of a cable tie for fixedly securing the lamp device to the gasket permits reduction of a unit cost and an assembly time period. Accordingly, the washing machine of the present invention has significantly high industrial applicability.

Moreover, the turning off of the LEDs at a preset time after turning on the LEDs permits turning off of the LEDs without any additional operation, and saves power. Accordingly, the washing machine of the present invention has significantly high industrial applicability.

The invention claimed is:

1. A washing machine, comprising:

a cabinet having a door on a front thereof;

a tub provided in the cabinet;

a drum rotatably mounted in the tub;

a gasket mounted to connect openings of the door and the tub; and a lamp device mounted on the gasket, the lamp device having a plurality of light emitting diodes mounted therein with a tilting angle such that the plurality of light emitting diodes is directed toward a center of the drum, wherein the lamp device includes:

a body;

a printed circuit board mounted in the body at a predetermined tilting angle, wherein the tilting angle of at least one of the plurality of light emitting diodes is the same as the predetermined tilting angle of the tinted circuit board; and a cap that protects the plurality of light emitting diodes and transmits light emitted by the plurality of light emitting diodes.

2. The washing machine as claimed in claim 1, wherein the gasket comprises a mounting hole, wherein the lamp device passes through and is mounted at the mounting hole.

3. The washing machine as claimed in claim 2, wherein the mounting hole projects from an outside circumference of the gasket.

4. The washing machine as claimed in claim 2, further comprising a cable tie provided to the mounting hole of the gasket that prevents the lamp device from falling off the gasket.

5. The washing machine as claimed in claim 1, wherein the lamp device is mounted at a center of an upper portion of the gasket.

6. The washing machine as claimed in claim 5, wherein the tilting angle of the printed circuit board or the plurality of light emitting diodes is in a range of 30° to 40° from a center of the body toward the drum.

7. The washing machine as claimed in claim 1, wherein the body of the lamp device comprises at least one wire pass through hole through which electric wires connected to the printed circuit board pass.

8. The washing machine as claimed in claim 1, wherein the lamp device further includes a coupling device that couples the body to the cap.

9. The washing machine as claimed in claim 8, wherein the coupling device includes:

a plurality of hooks on an outside circumference of the body; and a plurality of hook holes in an outside circumferential surface of the cap that respectively engage the plurality of hooks.

10. The washing machine as claimed in claim 1, wherein the lamp device further includes a printed circuit board supporter that fixedly secures the printed circuit board to the body.

11. The washing machine as claimed in claim 10, wherein the printed circuit board supporter includes:

a plate having an opening that exposes the plurality of light emitting diodes therethrough;

a first holding hole provided in the printed circuit board; and a first holding projection that projects from an underside of the plate with a tilting angle that engages with the first holding hole in the printed circuit board.

12. The washing machine as claimed in claim 11, wherein the printed circuit board supporter further includes:

a second holding projection that projects from a top of the body; and a second holding hole in the plate at a position opposite to the second holding projection that engages with the second holding projection.

* * * * *